US005922975A

United States Patent [19]

Butler et al.

[11] Patent Number: 5,922,975

[45] Date of Patent: Jul. 13, 1999

[54] MULTI-SCREEN GROUNDWATER MONITORING WELL SYSTEM

[76] Inventors: Gilbert S. Butler, 1409 Lexington Ave., Greensboro, N.C. 27403; Gilbert L. Davidson, 503 Davie Ave., Statesville, N.C. 28677

[21] Appl. No.: 08/990,683

[22] Filed: Dec. 15, 1997

[51] Int. Cl.[6] ..... E21B 49/08

[52] U.S. Cl. ..... 73/864.74

[58] Field of Search ..... 73/863.33, 864.33, 73/864.63, 864.64, 864.73, 864.74, 152.23, 152.26; 138/114; 116/264

[56] References Cited

U.S. PATENT DOCUMENTS

| | | | |
|---|---|---|---|
| 2,214,550 | 9/1940 | Edwards . | |
| 2,301,191 | 11/1942 | Boynton . | |
| 2,503,557 | 4/1950 | McKinley . | |
| 2,781,663 | 2/1957 | Maly et al. | 73/152.26 |
| 3,254,710 | 6/1966 | Jensen . | |
| 3,424,246 | 1/1969 | Myers . | |
| 3,454,085 | 7/1969 | Bostock . | |
| 3,650,148 | 3/1972 | Glenn, Jr. . | |
| 4,538,683 | 9/1985 | Chulick | 166/264 |
| 4,803,874 | 2/1989 | Marrast et al. . | |
| 4,838,079 | 6/1989 | Harris . | |
| 5,293,931 | 3/1994 | Nichols et al. . | |
| 5,375,478 | 12/1994 | Bernhardt . | |

FOREIGN PATENT DOCUMENTS

| | | | |
|---|---|---|---|
| 0702120 | 1/1954 | United Kingdom | 73/864.64 |

*Primary Examiner*—Robert Raevis
*Attorney, Agent, or Firm*—Barnes & Thornburg

[57] ABSTRACT

A system for communicating with underground fluids at different depths or along different lengths (i.e. in a horizontal fashion for SVE) in a common well which includes a plurality of connectable intersleeved casing sections that have apertures which can be manipulated to be open or closed. The intersleeved casing sections include outer sleeve members and an inner sleeve member which is movable with respect to the outer sleeve member. Movement of the inner sleeve member causes apertures therein to align with corresponding apertures in the outer sleeve member. The intersleeved casing sections are connected together by coupling members. Manipulation and opening of a selected intersleeved casing section from a plurality of coupled intersleeved casing sections which form a multi-screen casing allow fluids to be sampled, monitored, tested, remediated, removed or dispensed at a specific depth in a well.

21 Claims, 4 Drawing Sheets

MULTI-SCREEN GROUNDWATER MONITORING WELL SYSTEM

TECHNICAL FIELD

The present invention relates to methods and apparatus for communicating with subterranean horizons. More particularly, the present invention relates to methods and apparatus for selectively sampling and remediating underground fluids at several different depths in a sample well or borehole and associated testing and monitoring methods.

BACKGROUND ART

Since groundwater is a significant source of water for drinking, recreation and irrigation, its supply and purity are of paramount importance. Contaminants present as a constituent in groundwater can pose a significant risk, sometimes even in trace amounts. Therefore, groundwater monitoring for detecting the presence of contaminants is important in order to protect this source of water. In order to properly characterize a contaminant plume, a number of samples must be taken at different locations to ascertain how the concentration of the constituents vary from one location in a system to another and how they change over time. Since groundwater systems are three-dimensional and plume migration depends upon many factors, monitoring requires sampling each system at different locations in both the horizontal and vertical planes. Such multiple sampling in conjunction with hydrogeologic testing allows the evolution of a plume in an aquifer system to be predicted and thus, a remediation plan can be designed.

Contaminant vapors are sometimes concentrated in the vadose zone (non-saturated) when the plume is sufficiently high in concentration. These vapors may sometimes lead to explosion concerns or hazardous atmospheric conditions when they encounter confined spaces (i.e. basements, sewer lines, electrical conduits, etc.). Remediation of the is necessary in order to restore the entire environment to its prerelease condition and to prevent further contribution of contaminants to the groundwater through leaching of soils. Similar to groundwater plume monitoring, soil samples must be collected sufficiently to define a contaminated soil zone. After the contaminated soil zone is sufficiently defined, the soils must often be remediated. Excavation is not always cost effective, therefore the soil sometimes must be remediated through the use of soil vapor extraction.

Several different methods for providing access to multiple subsurface horizons for sampling, testing, and remediation exist as standard industry practice. One method employs installation of multiple monitoring wells, at varying depths to provide access to multiple subsurface horizons. A variation on this method would be the installation of several casings each to a different depth all within the same drilled borehole. Other methods of sampling groundwater at different depths are exemplified by U.S. Pat. Nos. 5,375,478 to Barnhardt; 5,293,931 to Nichols et al.; and 4,838,079 to Harris.

The present invention is directed to a subsurface casing well system which allows for adequate selective communication for the purposes of aquifer testing, sampling of fluids, and remediation through a single casing without the use of multiple boreholes or sampling ports.

DISCLOSURE OF THE INVENTION

The present invention provides an apparatus for communicating with underground fluids located at different depths which includes:

- a first member having an axis, an open space along the axis and a plurality of apertures which are selectively openable to provide fluid communication between an ambient environment and the open space; and
- a second member having an axis, an open space along the axis and being coupled to the first member so that the open space of the first member and the second member are continuous.

The present invention further provides a system for communicating with underground fluids located at different depths which includes:

- a borehole; and
- a fluid communication casing located in the borehole and having an axis and a continuous open axial space, the fluid communication casing comprising:
  - a first member having an axis, an open space along the axis and a plurality of apertures which are selectively openable to provide fluid communication between an ambient environment and the open space; and
  - a second member having an axis, an open space along the axis and being coupled to the first member so that the open space of the first member and the second member are continuous.

The present invention further provides a method of communicating with underground fluids present at different depths from a common borehole which involves:

- providing a borehole in the surface of a land area;
- providing a fluid communication casing having an axis and a continuous open axial space, the fluid communication casing including:
  - a first member having an axis, an open space along the axis and a plurality of apertures which are selectively openable to provide fluid communication between an ambient environment and the open space; and
  - a second member having an axis, an open space along the axis and being coupled to the first member so that the open space of the first member and the second member are continuous;
- installing the fluid communication casing in the borehole;
- opening the apertures in the first member to allow a fluid outside the fluid communication casing to enter the open space; and
- withdrawing or discharging a fluid sample from the open space.

BRIEF DESCRIPTION OF DRAWINGS

The present invention will be described hereafter with reference to the attached drawings which are given as non-limiting examples only, in which.

BEST MODE FOR CARRYING OUT THE INVENTION

Figure 1:
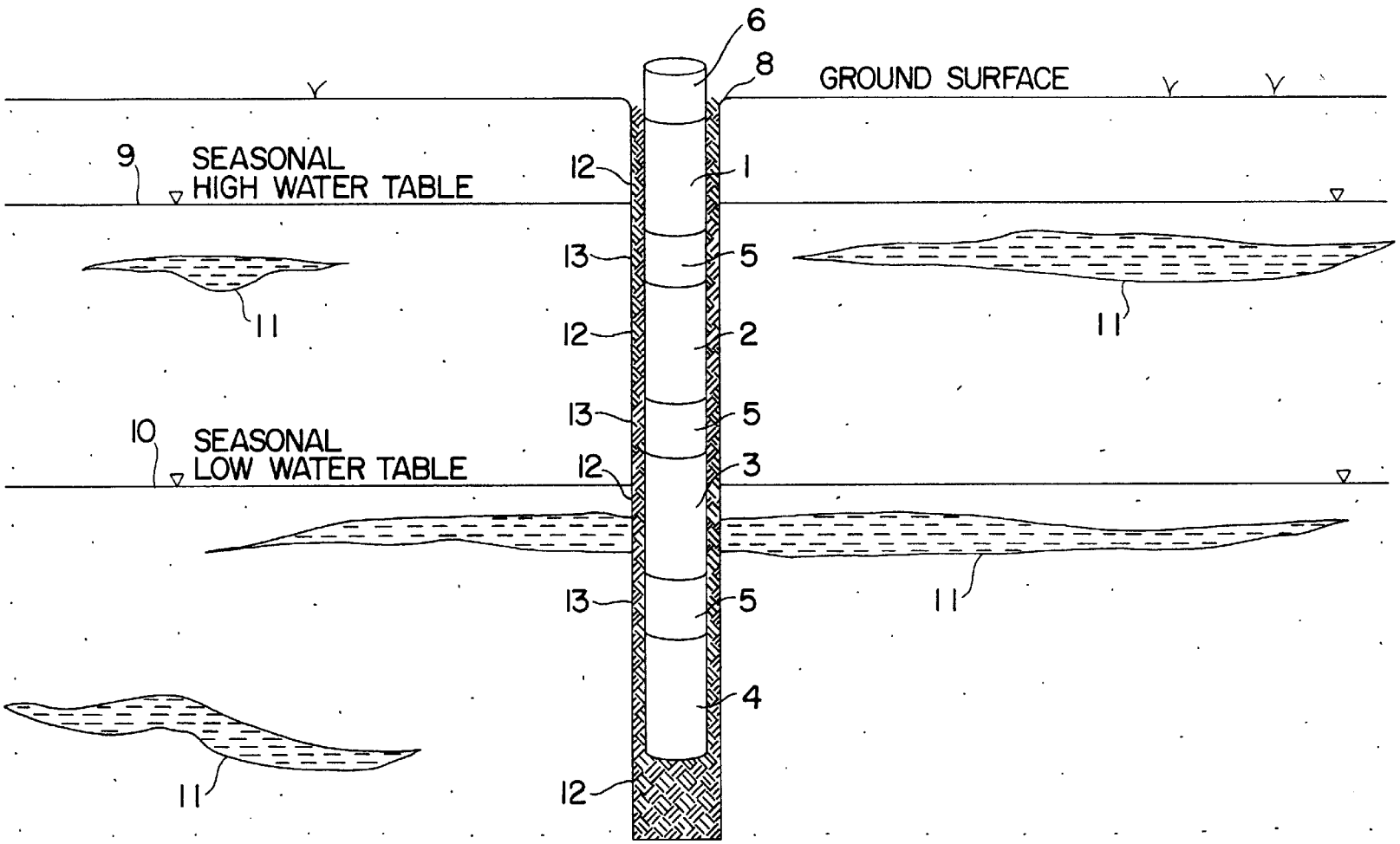
FIG. 1 is a side elevational view of a multi-screen groundwater monitoring well system according to one embodiment of the present invention.

The present invention is directed to a multi-screen subsurface casing system that is designed to allow adjustable communication between the casing and a surrounding formation (which may contain a fluid) selectively at multiple intervals or sections along the casing. One advantage of the system is the reduction in the cost of installation of one borehole as opposed to the installation of multiple boreholes which were needed heretofore to accomplish multiple functions. Such functions include the ability to: monitor different individual depth intervals, to adjust the depths of the effective horizons of a remediation system as the site may require, to allow more detailed hydrogeologic testing of an aquifer that has numerous semiconfining layers, and to allow straddling of the screened interval with the groundwater potentiometric surface at sites where a large seasonal water table fluctuation exists without using extensive screen lengths which may effect data quality. The design of the monitoring system of the present invention allows it to act as an ordinary monitoring well at multiple depth intervals without the installation of a series of "nested wells" or cost-prohibitive multi-port wells. The present invention can also be used as a soil vapor extraction well along its entire length without effecting a reduction in pressure and a loss in efficiency and radius of influence.

The multi-screen subsurface casing system of the present invention includes one or more intersleeved casing sections which can be coupled together in various arrangements to produce a multi-screened well casing capable of communication with formation fluids at different intervals. Each intersleeved casing section includes an inner sleeve member and an outer sleeve member. The inner sleeve member and outer sleeve member each include apertures, e.g. slots, which can be selectively aligned by moving one of the inner sleeve member or outer sleeve member with respect to the other until corresponding apertures in each are aligned. Once aligned, the apertures provide fluid communication between the inner sleeve member and the adjacent subsurface area.

When two or more intersleeved casing sections are used they are connected together at adjacent ends by a coupling member. The inner sleeve members are free to move within their respective outer sleeve members, independent of adjacent inner sleeve members. In this regard, the coupling members which join the intersleeved casing sections together separate adjacent inner sleeve members. This ability to independently move each of the inner sleeve members allows the apertures of any desired inner sleeve member to be aligned with corresponding apertures in its respective outer sleeve member. This alignment of the apertures in the inner sleeve members and outer sleeve members establishes fluid communication between the inner sleeve members and the adjacent subsurface and thus allows for selective sampling, remediation and hydrogeologic testing at different intervals.

The casing system is preferably enclosed or surrounded in some manner by a screening material which prevents the apertures in the outer casings from becoming obstructed by fines. The inner sleeve members and outer sleeve members of the casing system are preferably in sealed contact with one another so that little, or ideally no, fluid is allowed to enter the inner sleeve members when the apertures of the inner sleeve members and outer casings are out of alignment. Such a sealing relationship can be effected by providing a sealing member between the inner sleeve members and the outer sleeve members. For example, a resilient material such as neoprene can be provided as a seal liner between the inner sleeve members and the outer sleeve members. Such a seal liner needs to be stationary with respect to either the inter sleeve member or the outer sleeve member of each intersleeved casing section and would include apertures aligned with the apertures therein.

According to one embodiment, the apertures in the inner sleeve members and the outer sleeve members are aligned with one another by rotating the inner sleeve members with respect to the outer sleeve members. According to another embodiment, the apertures in the inner sleeve members and the outer sleeve members are aligned with one another by moving the inner sleeve members axially with respect to the outer sleeve members. In further embodiments, the apertures in the inner sleeve members and the outer sleeve members can be aligned with one another by a combination of angular and linear motion of the inner sleeve members with respect to the outer sleeve members, e.g. helical movement of the inner sleeve members.

The coupling members provide a length of casing which does not include sampling apertures or screens. The coupling members are used to position one or more of the intersleeved casing sections at a desired interval along the system of the present invention. For example, if it is desired to sample a particular aquifer at a depth of x, y, and z, three intersleeved casing sections are connected together by a suitable number of coupling members to produce a multi-screen casing having the intersleeved casing sections located axially at distances of x, z, and z so that they are positioned at appropriate depths when the multi-screened casing is installed in a well. Generally a single coupling member can be used to connect adjacent intersleeved casing sections. However, two or more coupling members or a coupling member having an extended length can be connected together to provide a desired spacing distance between adjacent sections of the casing system.

The intersleeved casing sections and the coupling members are provided with end structures by which they can be connected together. For example, the intersleeved casing sections and coupling members can include cooperating threaded structures at ends thereof so that they can be threaded together. Other suitable end structures can include bayonet coupling structures, clamping structures, pin-locking structures, etc. A seal member can be provided between connected coupling members and/or intersleeved casing sections in order to prevent ambient fluids from entering the system at the point where the coupling members and/or intersleeved casing sections are connected. According to another embodiment, the sealing member provided between the inner sleeve members and the outer sleeve member of the intersleeved casing sections can include ends that seal between the intersleeved casing sections and coupling member when they are connected together.

FIG. 1 is a side elevational view of a multi-screen subsurface casing system according to one embodiment of the present invention. The system of FIG. 1 includes four intersleeved casing sections 1–4 three coupling members 5, and a top section 6 that can include a cover and suitable means (not shown) for withdrawing samples from the system. The lowest intersleeved casing section 4 is provided with a closed end 7. The closed end 7 is connected to the outer sleeve member of intersleeved casing section 4. The intersleeved casing sections 1–4 and coupling members 5 define a multi-screen casing which is positioned in a borehole 8. As depicted in FIG. 1, borehole 8 intersects a number of subterranean formations, including seasonal high and seasonal low water tables 9, 10, and semi-confining horizons 11 (e.g. layers of clay). The borehole 8 is backfilled around the casing with alternate layers of sand 12 and clay 13, e.g. bentonite. As depicted, the layers of sand 12 are provided adjacent the intersleeved casing sections 1–4 and the layers of clay 13 are provided adjacent the coupling members 5. The layers of sand 12 are porous and thus allow fluids to enter the intersleeved casing sections 1–4. The layers of clay 13 are impermeable thus preventing fluids at different depths from co-mingling.

Figure 2:
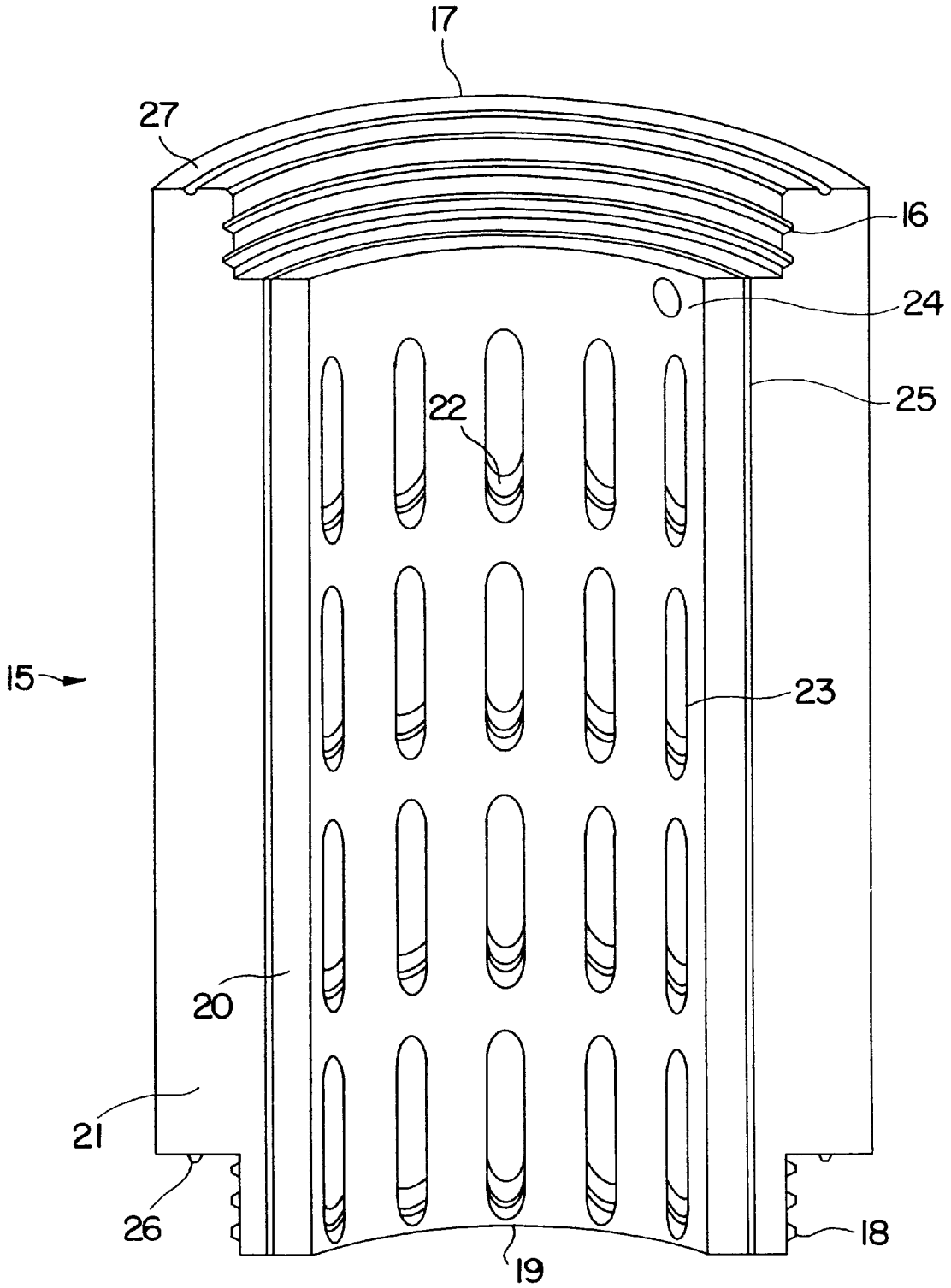
FIG. 2 is a cross sectional view of an intersleeved member according to one embodiment of the present invention.

FIG. 2 is a cross sectional view of an intersleeved casing section according to one embodiment of the present invention. The intersleeved casing section 15 has a generally cylindrical shape with threaded structures on opposite ends. The embodiment of the intersleeved casing sections depicted in FIG. 2 includes internal threads 16 on the upper end 17 and external threads 18 on the lower end 19. The use of internal threads 16 and external threads 18 on opposite ends of the intersleeved casing section(s) 15 and coupling members 30 ensures that the intersleeved casing sections 15 and coupling members 30 can only be joined together in a particular alignment. This alignment may be required depending on the type of movement tool notch 24 (discussed below) that is used to move the inner sleeve member 20 of the intersleeved casing section 15. Alternative structures, including bayonet coupling structure, clamping structures, pin-locking structures, etc. can be used to couple the intersleeved casing sections 15 and/or coupling member 30 together.

The threaded structures used to couple the intersleeved casing sections 15 and/or coupling members 30 together are provided on the outer sleeve member 21 of the intersleeved casing section 15. The outer sleeve member 21 includes a plurality of apertures 22, which are depicted as being elongated openings that are axially aligned with respect to the central axis of the intersleeved casing section 15. The inner sleeve member 20, which is depicted in a cut-away view, includes a plurality of apertures 23 which are complementary to the size and alignment of the apertures 22 in the outer sleeve member 21. The inner sleeve member 20 is substantially coextensive with the inner surface of the outer sleeve member 21 as depicted.

The inner sleeve member 20 is provided with a movement tool notch 24 at an upper edge as depicted in FIG. 2. The movement tool notch 24 is used to move the inner sleeve member 20 so that the apertures 23 thereof can be moved into and out of alignment with the apertures 22 in the outer sleeve member 21. In this regard, a tool (not shown) having a shape which can be received in and/or otherwise engaged with the movement tool notch 24 and an elongated handle is lowered down the center of the multi-screen casing defined by a plurality of intersleeved casing sections 15 and coupling members 30 so that the end thereof is received and/or engaged with the movement tool notch 24. Once engaged, the movement tool is moved, e.g. rotated, to cause the inner sleeve member 20 to rotate relative to the outer sleeve member 21. Proper movement of the inner sleeve member 20 with the movement tool causes the apertures 23 in the inner sleeve member 20 and the apertures 22 in the outer sleeve member 21 to become aligned or misaligned, as desired. The movement tool and/or the top of the multi-system casing can be provided with reference marks which will allow one to determine remotely the alignment of the apertures of the inner sleeve member 20 and the outer sleeve member 21. In an alternative embodiment, the inner sleeve member 20 and/or outer sleeve member 21 can be provided with abutting structures, e.g. slots and pins or abutting projections, which limit the movement of the inner sleeve member 20 between a position in which the apertures 23 of the inner sleeve member 20 are aligned with the apertures 22 of the outer sleeve member 21 and a position in which the apertures are not aligned. According to another embodiment, a releasable locking mechanism such as detente can be provided to lock the inner sleeve member 20 in a position in which the apertures 23 thereof are aligned with the apertures 22 of its respective outer sleeve member 21. Such a releasable locking mechanism will assist an operator in determining when the apertures are aligned.

Although one movement tool notch 24 is depicted in FIG. 2 two or more movement tool notches 24 could be provided in opposed, symmetrical or other desired positions in the inner sleeve member 20. It is also possible to provide the movement tool notch(es) 24 elsewhere than the upper portion of the inner sleeve member 20. For example, the movement tool notch(es) 24 could be provided in or near the axial center of the inner sleeve members 20. Providing the movement tool notch(es) 24 in the axial center of the inner sleeve members 20 will allow the intersleeved casing sections 15 to be used in either an upright or upside down orientation. Accordingly, in this embodiment the intersleeved casing sections 15 can be provided with similar threaded structures on both ends. For example, both ends of the intersleeved casing sections 15 could be provided with internal or external threads, and the coupling members 30 could be provided with the opposite threaded members on both ends.

A sealing member 25 can be provided between the inner sleeve member 20 and outer sleeve member 21. The sealing member 25 which is coextensive with the outer surface of the inner sleeve member 20 is depicted in a cut-away view in FIG. 2. The sealing member 25 includes a plurality of apertures which are aligned with the apertures 22 of the outer sleeve member 21. In the embodiment of the intersleeved casing section depicted in FIG. 2, the seal member 25 is stationary with respect to the outer sleeve member 21. An o-ring type seal 26 located on the lower end 19 of the intersleeved casing section 15 and surrounding the exterior threaded flange 18 and also on the lower end 34 of the coupling member 30 and surrounding the exterior threaded flange 33 ensures that no fluid will enter the casing system except through the apertures 22 and 23. When two sections of either coupling members or intersleeved casing sections are joined, the o-ring type seal 26 attached to the bottom of the intersleeved casing section or bottom of the coupling means 30 seats into a groove 27 cut into the top of intersleeved casing section or top of coupling means. In an alternative embodiment, the sealing member 25 could be secured to the outer sleeve member 21 by means of an adhesive or other interlocking structures. Moreover, the sealing member 25 could be provided as a coating on the outer sleeve member 21. As discussed above, the sealing member 25 could alternatively be stationary with respect to the inner sleeve member 20.

The sealing member 25 should be made from a resilient material such as neoprene. In order to ensure that the inner sleeve member 20 and outer sleeve member 21 are sufficiently easy to move relative to one another, the sealing member 25 should have a smooth contact surface with respect to the inner sleeve member 20 in the embodiment of FIG. 2. The inner sleeve member 20 and outer sleeve member 21 can be made from any suitable, non-corrosive material, including metals e.g. stainless steel and plastics e.g. polyvinyl chloride.

Figure 3:
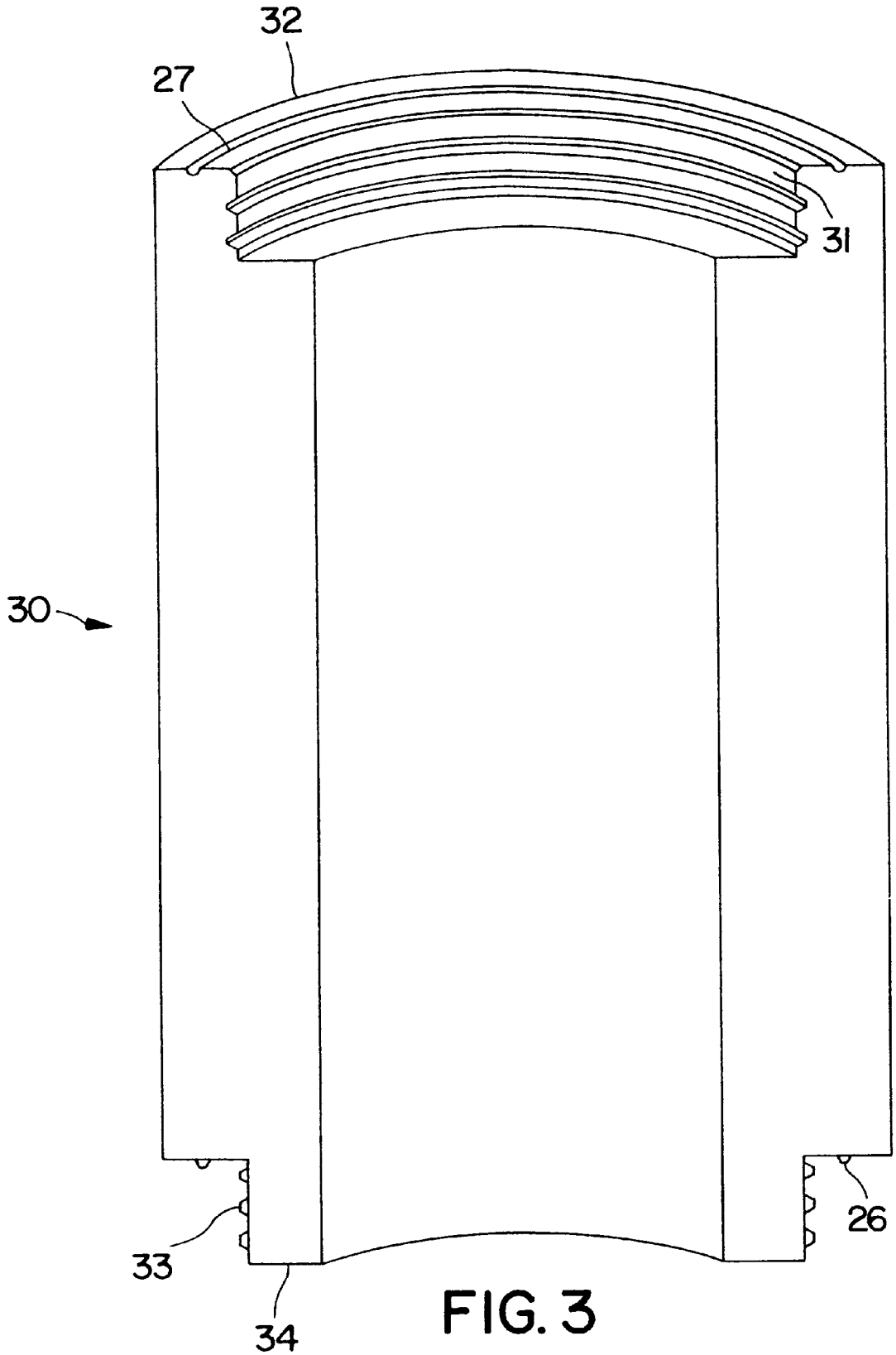
FIG. 3 is a cross sectional view of a divider according to one embodiment of the present invention.

FIG. 3 is a cross sectional view of a coupling member according to one embodiment of the present invention. The coupling member 30 of FIG. 3 has a generally cylindrical shape which is similar to the shape of the outer sleeve member 21 of FIG. 2. The coupling member 30 includes threaded structures on opposite ends which are similar to the threaded structures provided on the outer sleeve member 21 of the intersleeved casing section 15 of FIG. 2. Specifically, in order to connect the coupling member 30 to one or more of the intersleeved casing sections 15 of FIG. 3, the coupling member 30 includes internal threads 31 on one end 32 and external threads 33 on the other end 34. The use of internal threads 31 and external threads 33 on opposite ends of the coupling members 30 ensures that the intersleeved casing sections 15 and coupling members 30 can only be connected together in a particular alignment. Alternative structures, including bayonet coupling structure, clamping structures, pin-locking structures, etc. can be used to couple the intersleeved casing sections and/or coupling members together. According to a further embodiment which is discussed above, similar threaded structures, e.g. internal or external threads, could be provided on both ends of the coupling member 30.

The coupling member(s) 30 should preferably have an outer diameter which is equal to the outer diameter of an intersleeved casing section(s) 15 to which it is to be connected, and an inner diameter which is equal to the inner diameter of the inner sleeve member 20 of the intersleeved casing section 15. These diameters restrict axial movement of the inner sleeve members in a casing.

Figure 4:
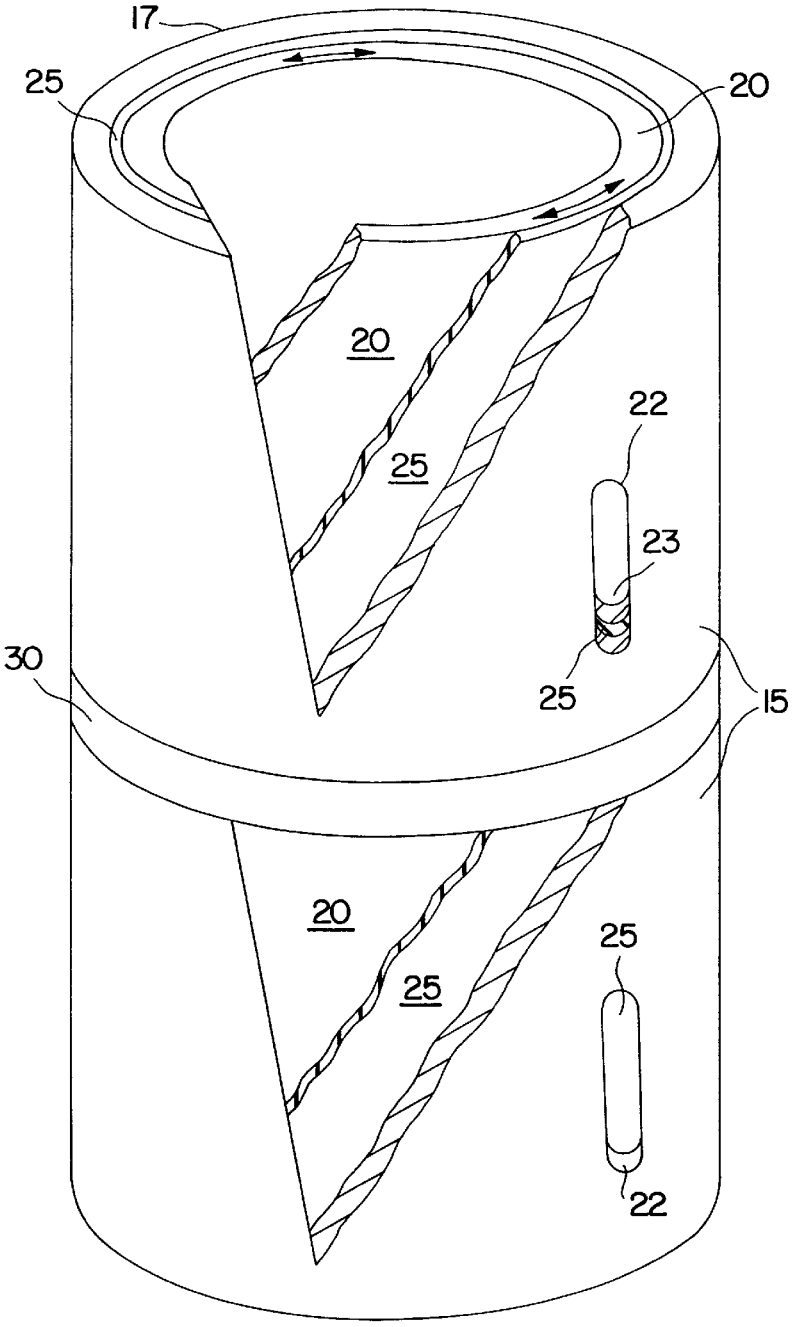
FIG. 4 is a cross sectional view of two intersleeved members which are separated by a divider or coupling member.

FIG. 4 is a cutaway view of two intersleeved casing sections 15 which are joined by a single coupling member 30. The intersleeved casing section 15 in FIG. 4 includes a sealing member 25 which has sealing flanges 27 on opposite ends. The seal 25 can be seen positioned between the inner sleeve member 20 and the outer sleeve member 21 visible through the outer sleeve member 21 and aperture in the cutaway.

The o-ring type seal (26 as shown in FIGS. 2 and 3) and seal seat (27 as shown on FIGS. 2 and 3) provide a gasket-like seal between the intersleeved casing section 15 and each of the coupling members 30. That is, the o-ring type seal 26 of either the lower end of an intersleeved casing section 15 or lower end of a coupling member 30 are received in the seal seat 27 of either the upper end 17 of an intersleeved casing section 15 or upper end 32 of a coupling member 30.

The two intersleeved casing sections 15 and adjoining coupling member 30 arrangement depicted in FIG. 4 illustrates a complete section of a multi-screened well system. The cutaway view depicts the various layers of the intersleeved casing section 15 with apertures 23 of the inner sleeve member 20 and apertures 22 of the outer sleeve member 21 with the sealing member 25 shown positioned in between. At the upper end 17 of the intersleeved casing section 15 the o-ring type seal seat is shown.

Figure 5A:
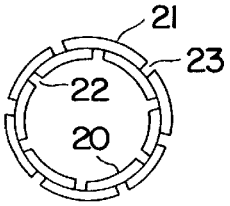
FIGS. 5*a* and 5*b* are schematic cross sectional diagrams which depict how the apertures of an intersleeved member are aligned.
Figure 5B:
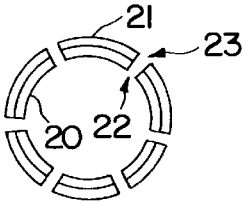

FIGS. 5*a* and 5*b* are schematic cross sectional diagrams which depict how the apertures of an intersleeved casing section are aligned. In FIG. 5*a* the apertures 23 in the inner sleeve member 20 are out of radial alignment with the corresponding apertures 22 in the outer sleeve member 21. Rotating the inner sleeve member 20 by inserting a movement tool in movement tool notch 24 and rotating the same causes the apertures 23 in the inner sleeve member 20 to become aligned with the apertures 22 in the outer sleeve member 21 as depicted in FIG. 5*b*.

In an alternative embodiment to that depicted in FIGS. 5*a* and 5*b*, the apertures 23 in the inner sleeve member 20 and the apertures 22 in the outer sleeve member 21 can be aligned by moving the inner sleeve member 20 axially. For example, the inner sleeve member 20 could be pulled up by a movement tool to align the apertures, and held in position by the movement tool during sampling. In this embodiment, releasing the inner sleeve member 20 from the movement tool can cause the inner sleeve member 20 to drop and close off alignment of the apertures. Such an automatic "closing" of the apertures when samples are not being taken will prevent the apertures from unintentionally being left open.

In further embodiments, one of the inner or outer sleeve member could be provided with apertures and the other member could be provided with sealing elements, e.g. projections, plugs, etc. which seal the apertures. In this embodiment, relative movement of one of the sleeve members will cause the sealing elements and apertures to become aligned or misaligned to effect sealing or opening of the apertures.

In addition to being useful for sampling underground water at different depths in a single well, the system of the present invention can be used in an underground formation which contains both DNAPLs (dense non-aqueous phase liquids, "sinkers") and LNAPLs (light non-aqueous phase liquids, "floaters").

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. An apparatus for communicating with underground fluids located at different locations which comprises:

a structure formed by connecting a plurality of discrete, connectable intersleeved sections, each of which includes:

an outer member having a plurality of apertures; and an inner member having a plurality of apertures, the inner member being located within the outer member and movable with respect thereto, whereby the apertures of the inner and outer members of isolated ones of the plurality of intersleeved sections can be selectively aligned by moving the inner members thereof.

2. An apparatus for communicating with underground fluids located at different locations according to claim 1, wherein the inner member of each of the plurality of intersleeved sections includes a catch for engagement therewith by a tool which can be used to move the inner members relative to their outer members.

3. An apparatus for communicating with underground fluids located at different locations according to claim 1, wherein each of the plurality of intersleeved sections further includes a sealing member between its inner and outer members.

4. An apparatus for communicating with underground fluids located at different locations according to claim 1, wherein each of the plurality intersleeved sections includes structure whereby the intersleeved sections can be coupled to one another.

5. An apparatus for communicating with underground fluids located at different locations according to claim 4, wherein the structure for coupling the intersleeved sections comprises threaded structures.

6. An apparatus for communicating with underground fluids located at different locations according to claim 1, further comprising coupling members that are coupled between adjacent ones of the plurality of intersleeved sections.

7. An apparatus for communicating with underground fluids located at different locations according to claim 6, further comprising sealing means between each coupling member and intersleeved section.

8. An apparatus for communicating with underground fluids located at different locations according to claim 1, wherein the plurality of apertures of the inner and outer members comprise elongated apertures which are aligned with axes of the inner and outer members.

9. An apparatus for communicating with underground fluids located at different locations according to claim 1, wherein the inner members of the plurality of intersleeved sections are rotatable with respect to the outer members thereof.

10. A system for communication with underground fluids located at different locations which comprises:

a borehole; and a fluid communication casing located in the borehole, the fluid communication casing comprising:

a plurality of discrete, connectable intersleeved sections, each of which includes:

an outer member having a plurality of apertures; and an inner member having a plurality of apertures, the inner member being located within the outer member and movable with respect thereto, whereby the apertures of the inner and outer members of isolated ones of the plurality of intersleeved sections can be selectively aligned by moving the inner members thereof.

11. A system for communication with underground fluids located at different locations according to claim 10, wherein the inner member of each of the plurality of intersleeved sections includes a catch for engagement therewith by a tool which can be used to move the inner members relative to their outer members.

12. A system for communication with underground fluids located at different locations according to claim 10, wherein each of the plurality of intersleeved sections further includes a sealing member between its inner and outer members.

13. A system for communication with underground fluids located at different locations according to claim 10, wherein each of the plurality intersleeved sections include structure whereby the intersleeved sections can be coupled to one another.

14. A system for communication with underground fluids located at different locations according to claim 13, wherein the structure for coupling the intersleeved sections comprises threaded structures.

15. A system for communication with underground fluids located at different locations according to claim 10, further comprising coupling members that are coupled between adjacent ones of the plurality of intersleeved sections.

16. A system for communication with underground fluids located at different locations according to claim 15, further comprising sealing means between each coupling member and intersleeved section.

17. A system for communication with underground fluids located at different locations according to claim 10, wherein the plurality of apertures of the inner and outer members comprise elongated apertures which are aligned with axes of the inner and outer members.

18. A system for communication with underground fluids located at different locations according to claim 10, wherein the inner members of the plurality of intersleeved sections are rotatable with respect to the outer members thereof.

19. A method of communication with underground fluids present at different depths from a common borehole which comprises:

providing a borehole in the surface of a land area;

providing a fluid communication casing having:

a plurality of discrete, connectable intersleeved sections, each of which includes:

an outer member having a plurality of apertures; and an inner member having a plurality of apertures, the inner member being located within the outer member and movable with respect thereto, whereby the apertures of the inner and outer members of isolated ones of the plurality of intersleeved sections can be selectively aligned by moving the inner members thereof installing the fluid communication casing in the borehole;

selecting one of the plurality of intersleeved sections;

moving the inner member of the selected intersleeved section to thereby align the apertures thereof with the apertures of the outer member of the selected intersleeved section;

transferring a fluid sample through the aligned apertures of the selected intersleeved section.

20. A method of communication with underground fluids present at different depths from a common borehole according to claim 19, wherein the inner member of the selected intersleeved section is rotated to effect alignment of the apertures.

21. A method of communication with underground fluids present at different depths from a common borehole according to claim 19, wherein the liquid sampled comprises water.

* * * * *